US007113140B2

(12) United States Patent
Nagano

(10) Patent No.: US 7,113,140 B2
(45) Date of Patent: Sep. 26, 2006

(54) CONVERTER FOR RADIO WAVE RECEPTION AND ANTENNA APPARATUS

(75) Inventor: Atsushi Nagano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 122 days.

(21) Appl. No.: 10/878,463

(22) Filed: Jun. 29, 2004

(65) Prior Publication Data

US 2005/0001776 A1 Jan. 6, 2005

(30) Foreign Application Priority Data

Jul. 1, 2003 (JP) ..... 2003-189431

(51) Int. Cl.
*H01Q 13/00* (2006.01)

(52) U.S. Cl. ..... 343/786

(58) Field of Classification Search ..... 343/786, 343/756, 762, 772, 773
See application file for complete search history.

(56) References Cited

U.S. PATENT DOCUMENTS

| | | | | |
|---|---|---|---|---|
| 4,058,813 A | | 11/1977 | Risko | 343/786 |
| 4,707,702 A | | 11/1987 | Withers | 343/786 |
| 4,896,163 A | | 1/1990 | Shibata et al. | 343/786 |
| 5,229,780 A | * | 7/1993 | Hirotsu et al. | 343/713 |
| 5,334,989 A | * | 8/1994 | Nagayama et al. | 343/713 |
| 5,933,119 A | * | 8/1999 | Fujii et al. | 343/713 |
| 6,011,524 A | | 1/2000 | Jervis | 343/895 |
| 6,064,345 A | * | 5/2000 | Ohnishi et al. | 343/713 |
| 6,121,934 A | * | 9/2000 | Taniguchi et al. | 343/713 |

FOREIGN PATENT DOCUMENTS

| | | |
|---|---|---|
| JP | 62-100710 | 6/1987 |
| JP | 64-5501 | 1/1989 |
| JP | 64-15410 | 1/1989 |
| JP | 2-75226 | 3/1990 |
| JP | 4-57927 | 5/1992 |

* cited by examiner

*Primary Examiner*—Trinh Dinh
*Assistant Examiner*—Huedung X. Cao
(74) *Attorney, Agent, or Firm*—Nixon & Vanderhye P.C.

(57) ABSTRACT

A radio wave reception converter receives a radio wave and converts the radio wave into an electric signal, and includes a horn introducing a radio wave, and a waveguide arranged at the rear of the horn for guiding a radio wave introduced by the horn. An insulation sheet is located between the waveguide and the horn to seal hermetically the interior of the waveguide and the horn. The connecting part between the waveguide and the horn is covered with an exterior cabinet. The front opening of the horn is covered with a feedome. The structure facilitates the connecting work between the waveguide and the horn, and can ensure air-tightness at the connecting part.

11 Claims, 5 Drawing Sheets

CONVERTER FOR RADIO WAVE RECEPTION AND ANTENNA APPARATUS

This nonprovisional application is based on Japanese Patent Application No. 2003-189431 filed with the Japan Patent Office on Jul. 1, 2003, the entire contents of which are hereby incorporated by reference.

BACKGROUND OF THE INVENTION

1. Field of the Invention

The present invention relates to a radio wave reception converter (LNB: Low Noise Block down Converter) receiving radio waves such as those of satellite broadcasting and converting the radio wave into an electric signal, and an antenna apparatus including such a radio wave reception converter.

2. Description of the Background Art

FIG. 7 is a sectional view of a structure of a conventional radio wave reception converter.

As shown in FIG. 7, the conventional radio wave reception converter has a horn 102 secured by a screw 109*a* to a chassis main unit 101 having a waveguide 110. Connection between horn 102 arid an exterior cabinet 105 is established by attaching a nut 124 to the screw portion of an output terminal 108 provided at chassis main unit 101. Accordingly, exterior cabinet 105 is urged against and secured to horn 102: At the front of horn 102, a feedome 104 (also called horn cap) is secured by a screw 109*b*.

An O ring 111 is located at the connection between horn 102 and exterior cabinet 105. Additionally, an O ring 113 is located at the connection between exterior cabinet 105 and output terminal 108. These O rings function to establish hermetic sealing of the interior of exterior cabinet 105 against outside air. Furthermore, an O ring 112 is located at the connection between feedome 104 and horn 102. This O ring functions to establish hermetic sealing of the interior of horn 102 and the interior of waveguide 110 against outside air.

FIG. 8 is a sectional view of a structure of another conventional radio wave reception converter.

As shown in FIG. 8, this another conventional radio wave reception converter has a horn 202 press-fitted and secured at the front end of a waveguide 210 formed of a cylindrical metal pipe. At the rear of waveguide 210, a circuit board 207 having a converter circuit formed is attached. Waveguide 210, horn 202 and circuit board 207 are covered with bisected exterior cabinets 205*a*, 205*b* and feedome 204. Connection of the bisected exterior cabinets 205*a* and 205*b* is established through press-fitting or adhesion-fixing. Additionally, connection between exterior cabinet 205*a* and feedome 204 is established by press-fitting or adhesion-fixing. Thus, the interior of the radio wave reception converter is maintained in an airtight manner.

The structure of other conventional radio wave reception converters is disclosed in, for example, Japanese Utility Model Laying-Open No. 64-5501, Japanese Utility Model Laying-Open No. 64-15410, Japanese Patent Laying-Open No. 2-75226, Japanese Utility Model Laying-Open No. 62-100710, Japanese Utility Model. Laying-Open No. 4-57927, and the like.

The radio wave reception converter of the structure shown in FIG. 7 has the problem that extremely strict accuracy is required in the surface roughness of respective faces of feedome 104, horn 102, exterior cabinet 105 and the like brought into contact with O rings 111–113 as well as the dimension of the groove in which O rings 111–113 are fitted since airtightness is ensured by O rings 111–113. If the accuracy of such elements are not maintained at a high level, moist air will flow into the radio wave reception converter to significantly degrade the product lifetime. It is therefore necessary to realize the high accuracy set forth above, imposing constraints on the fabrication cost.

The radio wave reception converter of the structure shown in FIG. 8 is absent of O rings, and maintains airtightness by press-fitting or adhesion-fixing. This imposes the problem that strict dimension accuracy is required. However, exterior cabinets 205*a* and 205*b* as well as feedome 204 are generally resin-formed components, relatively harder to achieve critical dimension accuracy as compared to metal. Therefore, when the press-fitting process is employed, airtightness of a level that can prevent intrusion of rain can be ensured. However, it is extremely difficult to prevent intrusion of moist air. In the case where adhesion-fixing is employed, the working process becomes tedious since the adhesive must be applied evenly over the entire face of connection. Furthermore, overflow of the adhesion will become the cause of deterioration in appearance.

SUMMARY OF THE INVENTION

An object of the present invention is to provide a radio wave reception converter that has the connecting work between a waveguide and a horn facilitated, and that can ensure airtightness at the connection thereof, and an antenna apparatus including such a radio wave reception converter.

A radio wave reception converter according to an aspect of the present invention receives a radio wave and converts the radio wave into an electric signal. The radio wave reception converter includes a horn for introducing a radio wave, and a waveguide arranged at the rear of the horn for guiding the radio wave introduced by the horn. An insulation sheet is located between the waveguide and the horn. The interior of the waveguide and the interior of the horn are sealed in an airtight manner by the insulation sheet. By the structure of providing and sandwiching the insulation sheet between the waveguide and the horn, the interior of the waveguide can be sealed hermetically against outside air. Since intrusion of moist air can be prevented thereby, the reliability of the apparatus is improved.

In the radio wave reception converter according to the aspect set forth above of the present invention, the connecting part between the horn and the waveguide is covered with a casing, and the opening at the front of the horn is preferably covered with a feedome. Since intrusion of air into the casing and the horn can be prevented by such a structure, the reliability of the apparatus is improved.

In the radio wave reception converter according to the aspect set forth above of the present invention, the inner diameter of the feedome is set smaller than the outer diameter of the horn to press-fit and secure the feedome into the horn. By such a structure, connection between the feedome and the horn is facilitated.

The radio wave reception converter according to the aspect set forth above of the present invention preferably has a structure in which a salient is formed at an end plane of the horn facing the waveguide, a reentrant is formed at an end plane of the waveguide facing the horn to receive the salient, and the circumferential edge of the insulation sheet is sandwiched by the salient and reentrant. In the radio wave reception converter according to the aspect set forth above of the present invention, a structure may be employed in which a salient is formed at an end plane of the waveguide facing the horn, a reentrant is formed at an end plane of the horn facing the waveguide to receive the salient, and the circumferential edge of the insulation sheet is sandwiched by the salient and reentrant. By such a structure, connection between the horn and the waveguide can be facilitated, and airtightness can be ensured by the insulation sheet.

In the radio wave reception converter according to the aspect set forth above of the present invention, preferably a structure is employed in which a horn side flange is provided at the rear end of the horn, and a waveguide side flange is provided at the front end of the waveguide. The horn side flange and the waveguide side flange are fastened by fastening means. By such a structure, the insulation sheet can be sandwiched reliably by the horn and the waveguide through a simple working process.

In the radio wave reception converter according to the aspect of the present invention set forth above, the insulation sheet is preferably a plastic sheet having an adhesive applied on the main surface. Application of an adhesive on the main surface of the insulation sheet allows one of the horn or waveguide to be attached to the insulation sheet, followed by connection between the horn and the waveguide. Therefore, the work is facilitated. The problem of the insulation sheet being shifted in position can also be eliminated. Hermetic sealing can be maintained reliably.

An antenna apparatus according to the present invention includes any of the radio wave reception converter set forth above, and a parabola reflecting and introducing into the radio wave reception converter a radio wave. By such a structure, an antenna apparatus of high reliability can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

A structure of a radio wave reception converter according to a first embodiment of the present invention will be described hereinafter with reference to FIG. 1.

Figure 1:
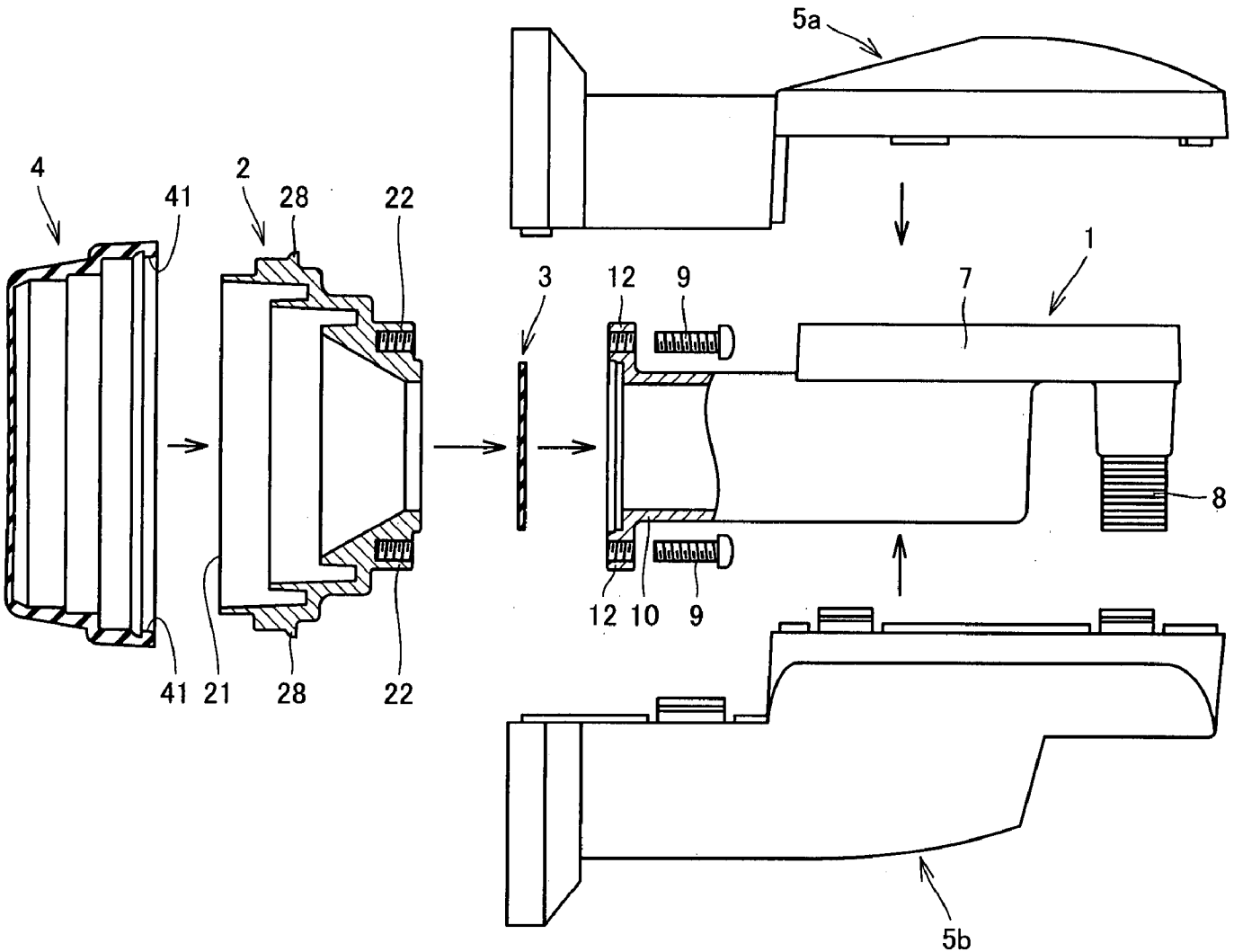
FIG. 1 is a partially fractured side view of an assembly structure of a radio wave reception converter according to a first embodiment of the present invention.

Referring to FIG. 1, the radio wave reception converter of the present embodiment mainly includes a chassis main unit 1, a horn 2, an insulation sheet 3, a feedome 4, and exterior cabinets 5*a* and 5*b*.

Chassis main unit 1 includes a cylindrical waveguide 10 for guiding a radio wave, high frequency circuitry 7 in which is sealed a high frequency circuit substrate (not shown) incorporated with a low noise amplifier and the like, and an F type attachment 8 that is a connection terminal. Waveguide 10 is formed of, for example, a metal pipe, or a resin pipe having metal plating on the inner circumferential face. A substrate antenna (not shown) extending from the high frequency circuit substrate is located at the rear of waveguide 10 to receive a radio wave guided by waveguide 10. The received signal is frequency-converted by the high frequency circuit, amplified, and then output to an external source via F type attachment 8.

Horn 2 is the part where a radio wave reflected at the parabola of the antenna apparatus is introduced. The radio wave passing through a front opening 21 is guided towards the rear. Horn 2 is a metal shaped piece formed by, for example, press working, or a resin molded piece having metal plating applied on the inner face.

Insulation sheet 3 is a disk member formed of, for example, PET (polyethylene terephthalate) resin, PP (polypropylene) resin, polyimide resin, Teflon (registered trademark) resin or the like, having its thickness adjusted to several 10 μm. Insulation sheet 3 is formed in a desired shape by, for example, die-cutting a rectangular sheet. Insulation sheet 3 preferably has an adhesive (tenacious material) applied on one or both sides of the main surface.

Feedome 4 is a member attached to horn 2 so as to occlude front opening 21 of horn 2. Feedome 4 is a formed piece such as a resin member.

Exterior cabinets 5*a* and 5*b* identified as the casing are divided into two, covering chassis main unit 1. Exterior cabinets 5*a* and 5*b* are formed pieces of resin.

Assembly of respective components are carried out by the procedures set forth below.

First, insulation sheet 3 is attached at the front end side of waveguide 10 of chassis main unit 1. Horn 2 is attached to the front end of waveguide 10 by means of a screw 9 which is a fastening means. Insulation sheet 3 is located between the front end plane of waveguide 10 and the back end plane of horn 2.

Then, feedome 4 is attached to horn 2 so as to cover front opening 21 of horn 2. Finally, bisected exterior cabinets 5*a* and 5*b* are fitted so as to cover the connecting part between waveguide 10 of chassis main unit 1 and horn 2. Thus, the radio wave reception converter is assembled.

Figure 2:
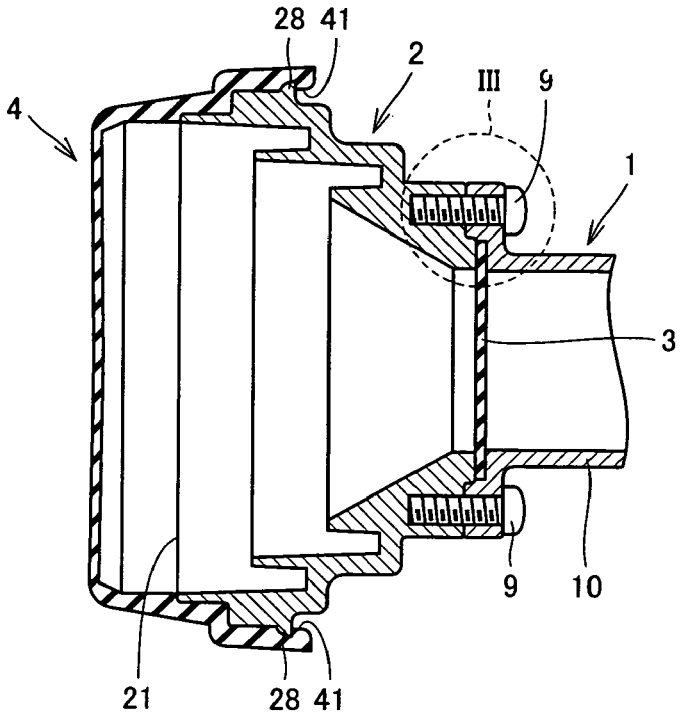
FIG. 2 is a sectional view of the connection between a waveguide and horn of the radio wave reception converter according to the first embodiment of the present invention.
Figure 3:
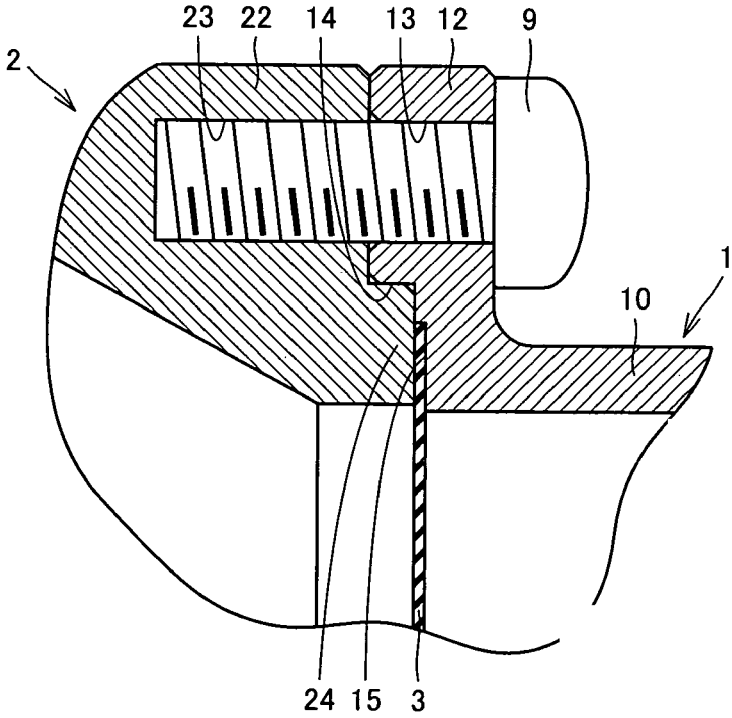
FIG. 3 is an enlarged sectional view of region III of FIG. 2.

As shown in FIGS. 2 and 3, the radio wave reception converter of the present embodiment has insulation sheet 3 located and sandwiched between waveguide 10 and horn 2.

Specifically, a salient 24 is provided at the end plane of horn 2 facing waveguide 10, and a reentrant 14 is formed at the end plane of waveguide 10 facing horn 2. Reentrant 14 of waveguide 10 receives salient 24 formed in horn 2. Insulation sheet 3 is located between salient 24 and reentrant 14. The circumferential edge of insulation sheet 3 is sandwiched between salient 24 and reentrant 14.

A waveguide side flange 12 is provided at the front end of waveguide 10. A horn side flange 22 provided at the rear end of horn 2. A through hole 13 is formed in waveguide side flange 12. A screw hole 23 is formed at horn side flange 22 at a position corresponding to through hole 13. Screw 9 is inserted through through hole 13. Waveguide 10 and horn 2 are secured by screw 9 fixed in screw hole 23. By adjusting insulation sheet 3 to a predetermined thickness, insulation sheet 3 is compressed and deformed to be sandwiched between waveguide 10 and horn 2. Therefore, hermetic sealing is ensured at this portion.

At the bottom of reentrant 14 provided at the end plane of waveguide 10, a reentrant 15 of a size corresponding to the configuration of insulation sheet 3 is formed. By setting the depth of this reentrant 15 equal to or slightly smaller than the thickness of insulation sheet 3, the gap between waveguide 10 and horn 2 can be reduced even if insulation sheet 3 is made thicker. Therefore, leakage of radio wave can be prevented. Since a thick insulation sheet 3 can be used by such a structure, hermetic sealing can be achieved more ensurely.

As shown in FIG. 2, feedome 4 is press-fitted and fixed at the front end of horn 2. Specifically, the inner diameter of feedome 4 is set slightly smaller than the outer diameter of horn 2. Press-fit fixation can be established by fitting feedome 4 to horn 2. A claw 41 is provided at the rear end of feedome 4 to prevent feedome 4 from being detached from horn 2. Fitting is established to engage claw 41 with projection 28 located at a predetermined position at the outer circumferential plane of horn 2. This prevents rain from intruding through front opening 21 of horn 2.

By the radio wave reception converter of the above structure, intrusion of rain through the connecting part of bisected exterior cabinets 5*a* and 5*b* and the connecting part between horn 2 and feedome 4 is prevented. Furthermore, the moist air introduced through the gaps thereof is prevented from flowing into waveguide 10 by insulation sheet 3. Therefore, various electronic components such as the high frequency circuit substrate and the like arranged in high frequency circuitry 7 is protected from moisture. As a result, a radio wave reception converter of high reliability can be provided.

Since the connection structure set forth above can be realized by the simple working steps of attaching insulation sheet 3 to the end plane of waveguide 10, and fastening waveguide 10 with horn 2 by means of screw 9, the assembly work will not become tedious. Furthermore, the fabrication cost can be reduced significantly since critical surface roughness or dimension accuracy are not required.

Furthermore, since the connection between bisected exterior cabinets 5*a* and 5*b* and the connection between horn 2 and feedome 4 are conducted by press-fitting, it is no longer necessary to use an adhesive. The problem of deterioration in the outer appearance caused by overflow of the adhesive can be eliminated.

Complete blocking of the path of waveguide 10 and the path of horn 2 by means of insulation sheet 3 in the radio wave reception converter of the present embodiment allows the interior of waveguide 10 to be sealed hermetically against outside air. By virtue of insulation sheet 3 having the thickness of several 10 μm as set forth above, most of the radio waves introduced into horn 2 will pass through insulation sheet 3 and reach the interior of waveguide 10. There is little, if any, loss in radio wave by such arrangement of an insulation sheet 3.

Figure 4:
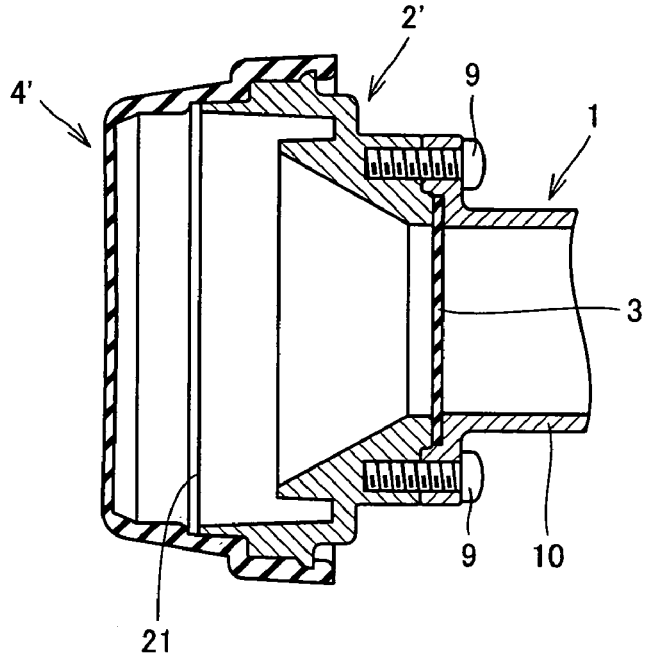
FIG. 4 is a sectional view of the connection when a horn having an angular aperture differing from that of the horn of FIG. 2 is connected.

By the structure of dividing the feed horn that guides a radio wave into waveguide 10 and horn 2 as in the present embodiment, most of the components of a radio wave reception converter having a different angular aperture depending upon the specification can be used in common. Specifically, a horn 2' having an angular aperture differing from that of FIG. 2 is additionally prepared, as shown in FIG. 4. By setting the configuration of the connecting part between horn 2' and waveguide 10 identical to that of horn 2 shown in FIG. 2, the components of chassis main unit 1 including waveguide 10 and external cabinets 5*a* and 5*b* can be used in common. Versatility can be improved. Accordingly, a radio wave reception converter differing in angular aperture can be produced economically.

Second Embodiment

The connection structure of the waveguide and horn of a radio wave reception converter according to a second embodiment of the present invention will be described with reference to FIG. 5. Elements similar to those of the first embodiment have the same reference characters allotted in the drawings, and description thereof will not be repeated.

Figure 5:
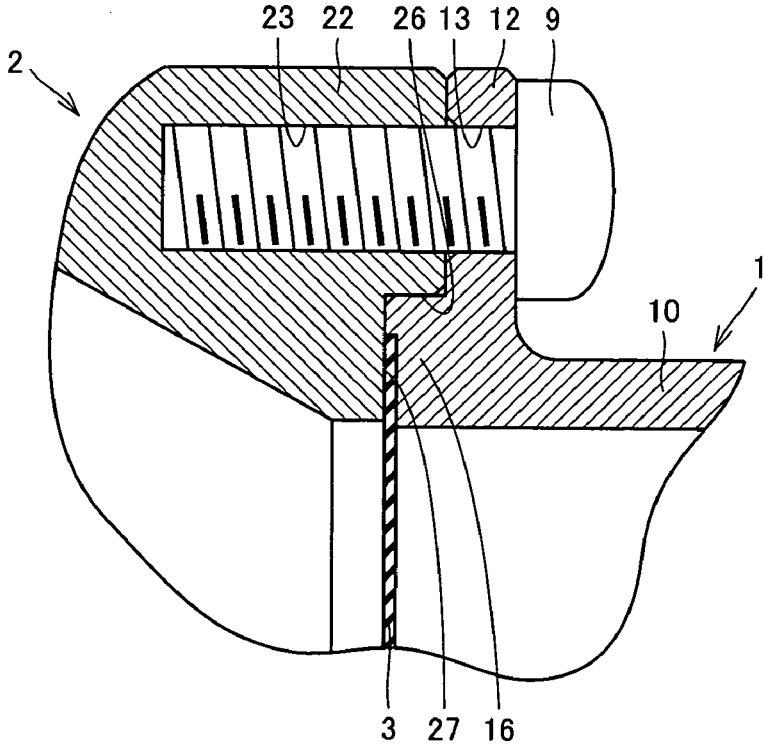
FIG. 5 is an enlarged sectional view of the connection between a waveguide and horn of a radio wave reception converter according to a second embodiment of the present invention.

As shown in FIG. 5, the radio wave reception converter of the present embodiment has insulation sheet 3 located and sandwiched between waveguide 10 and horn 2.

Specifically, a salient 16 is formed at the end plane of waveguide 10 facing horn 2, and a reentrant 26 is formed at the end plane of horn 2 facing waveguide 10. Reentrant 26 of horn 2 receives salient 16 of waveguide 10. Insulation sheet 3 is located between salient 16 and reentrant 26. The circumferential edge of insulation sheet 3 is sandwiched between salient 16 and reentrant 26.

Waveguide side flange 12 is provided at the front end of waveguide 10. Horn side flange 22 is provided at the rear end of horn 2. Through hole 13 is formed at waveguide side flange 12. Screw hole 23 is formed at horn side flange 22 at a position corresponding to through hole 13. Screw 9 is inserted through through hole 13. Waveguide 10 is secured with horn 2 by screw 9 being fixed in screw hole 23. By adjusting insulation sheet 3 to a predetermined thickness, insulation sheet 3 is compressed and deformed by waveguide 10 and horn 2 to be sandwiched therebetween. Therefore, hermetic sealing at this region can be ensured.

A reentrant 27 of a size corresponding to the configuration of insulation sheet 3 is formed at the bottom of reentrant 26 provided at the end plane of horn 2. By setting the depth of reentrant 27 equal to or slightly smaller than the thickness of insulation sheet 3, the gap between waveguide 10 and horn 2 can be reduced even if insulation sheet 3 is made thicker. Therefore, radio wave leakage can be prevented. Since a thick insulation sheet 3 can be used by such a structure, hermetic sealing can be achieved more ensurely.

The structure set forth above has an advantage similar to that of the first embodiment.

Third Embodiment

A structure of an antenna apparatus according to a third embodiment of the present invention will be described with reference to FIG. 6.

Figure 6:
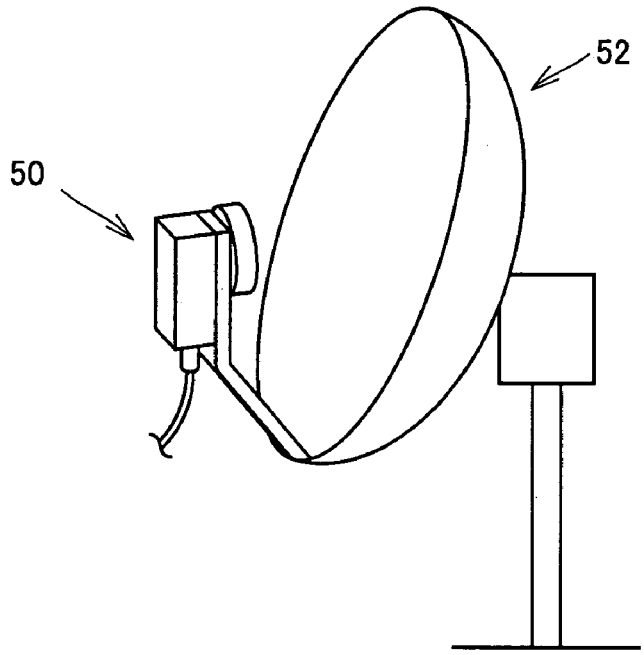
FIG. 6 is a perspective view schematically showing a structure of an antenna apparatus according to a third embodiment of the present invention.
Figure 7:
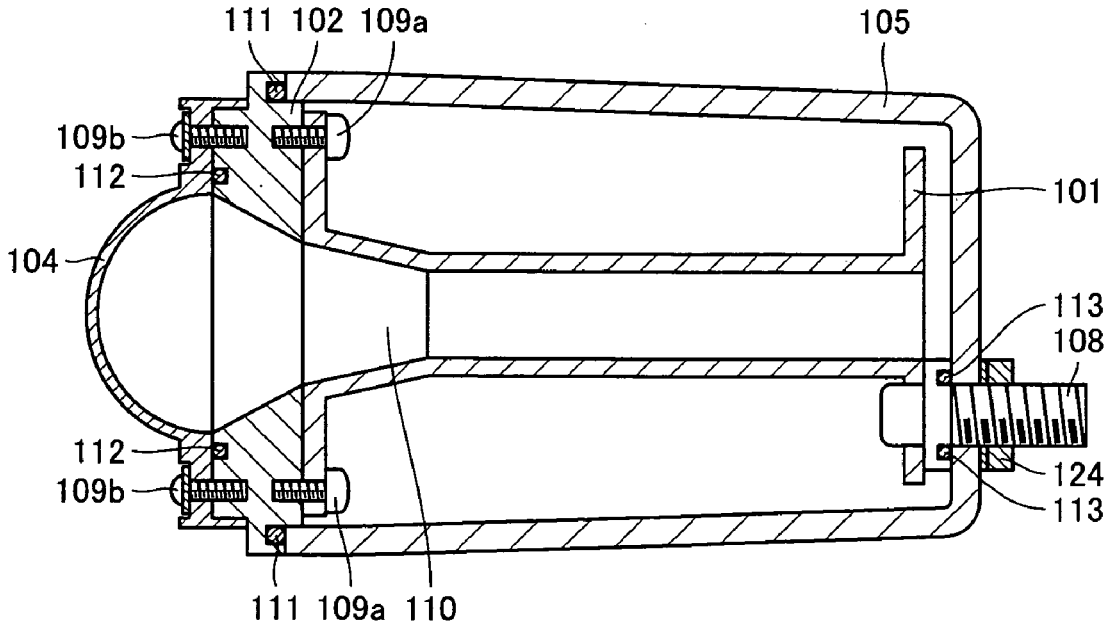
FIG.7 PRIOR ART
FIG. 7 is a sectional view of a structure of a conventional radio wave reception converter.
Figure 8:
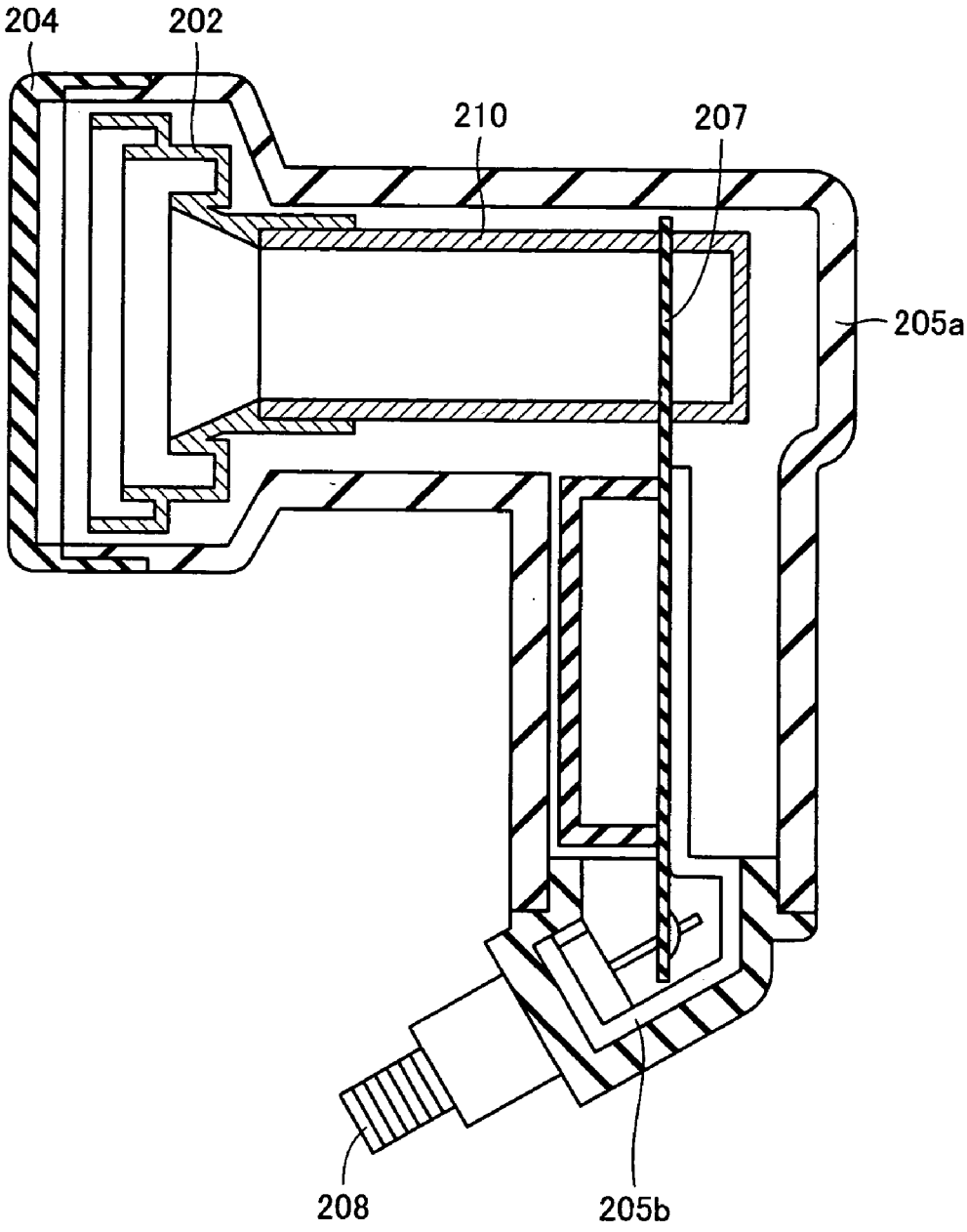
FIG.8 PRIOR ART
FIG. 8 is a sectional view of a structure of another conventional radio wave reception converter.

Referring to FIG. 6, the antenna apparatus of the present embodiment includes a radio wave reception converter 50 and a parabola 52. Radio wave reception converter 50 corresponds to the radio wave reception converter of the first or second embodiment set forth above.

The radio wave from a satellite is reflected and concentrated by parabola 52 to be introduced into the horn of radio wave reception converter 50 arranged in front of parabola 52. The radio wave from a satellite is a circularly polarized wave, including a right-handed polarized wave and a left-handed polarized wave. Radio wave reception converter 50 separates these two components, amplifies respective components, and converts the radio wave in a band of ten several GHz to a signal of the frequency band of 1 GHz. The converted signal passes through a cable connected to the F type attachment of radio wave reception converter 50 and an indoor receiver (for example, a satellite receiver) to be send to a television.

By the above-described structure, an antenna apparatus maintaining high reliability can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A radio wave reception converter receiving a radio wave and converting the radio wave into an electric signal, comprising:

a horn introducing a radio wave, a waveguide arranged at a rear of said horn to guide a radio wave introduced by said horn, an insulation sheet located between said waveguide and said horn to seal hermetically the interior of said waveguide and the interior of said horns, an antenna provided at a rear of the waveguide for receiving the radio wave guided by the waveguide, and wherein the insulating sheet is located between (a) the horn, and (b) a front end of the waveguide where the wave is first received from the horn.

2. The radio wave reception converter according to claim 1, further comprising a casing covering a connecting part of said horn and said waveguide, and a feedome covering a front opening of said horn.

3. The radio wave reception converter according to claim 2, wherein said feedome has an inner diameter smaller than an outer diameter of said horn, and said feedome is press-fitted to said horn.

4. The radio wave reception converter according to claim 1, wherein said horn has a salient at an end plane facing said waveguide, and said wavequide has a reentrant receiving said salient at an end plane facing said horn, said insulation sheet having its circumferential edge sandwiched by said salient and said reentrant.

5. The radio wave reception converter according to claim 1, wherein said waveguide has a salient at an end plane facing said horn, and said horn has a reentrant receiving said salient at an end plane facing said waveguide, said insulation sheet having its circumferential edge sandwiched by said salient and said reentrant.

6. The radio wave reception converter according to claim 1, wherein a horn side flange is provided at a rear end of said horn, and a waveguide side flange is provided at a front end of said waveguide, said horn side flange and said waveguide side flange being fastened by fastening means.

7. The radio wave reception converter according to claim 1, wherein said insulation sheet is a plastic sheet having an adhesive applied at a main surface.

8. The radio wave reception converter according to claim 1, wherein the insulating sheet is located between and directly contacting each of a rear end of the horn and the front end of the waveguide.

9. An antenna apparatus comprising:

a radio wave reception converter including a horn unit introducing a radio wave, a waveguide arranged at a rear of said horn to guide a radio wave introduced by said horn, and an insulation sheet located between said waveguide and said horn to seal hermetically the interior of said waveguide and the interior of said horn, a parabola reflecting a radio wave and introducing the radio wave to said radio wave reception converters, an antenna provided at a rear of the waveguide for receiving the radio wave guided by the waveguide, and wherein the insulating sheet is located between (a) the horn, and (b) a front end of the waveguide where the wave is first received from the horn.

10. A radio wave reception converter receiving a radio wave and converting the radio wave into an electric signal, comprising:

a horn introducing a radio wave, a waveguide arranged at a rear of said horn to guide a radio wave introduced by said horn, an insulation sheet located between said waveguide and said horn to seal hermetically the interior of said waveguide and the interior of said horn, and wherein said horn has a salient at an end plane facing said waveguide, and said wavequide has a reentrant receiving said salient at an end plane facing said horn, said insulation sheet having its circumferential edge sandwiched by said salient and said reentrant.

11. A radio wave reception converter receiving a radio wave and converting the radio wave into an electric signal, comprising:

a horn introducing a radio wave, a waveguide arranged at a rear of said horn to guide a radio wave introduced by said horn, an insulation sheet located between said waveguide and said horn to seal hermetically the interior of said waveguide and the interior of said horn, and wherein said waveguide has a salient at an end plane facing said horn, and said horn has a reentrant receiving said salient at an end plane facing said waveguide, said insulation sheet having its circumferential edge sandwiched by said salient and said reentrant.

* * * * *